United States Patent [19]

Orlow

[11] 4,442,742

[45] Apr. 17, 1984

[54] ROTARY APPARATUS FOR FORMING SHEETS WITH ROUNDED CORNERS

[75] Inventor: Ralph S. Orlow, Anaheim, Calif.

[73] Assignee: Box Innards, Inc., Orange, Calif.

[21] Appl. No.: 335,580

[22] Filed: Dec. 29, 1981

[51] Int. Cl.[3] ..... B26D 1/56

[52] U.S. Cl. ..... 83/303

[58] Field of Search ..... 83/300, 301, 302, 303

[56] References Cited

U.S. PATENT DOCUMENTS

| | | | |
|---|---|---|---|
| 1,837,727 | 12/1931 | Novick | 83/303 |
| 2,345,411 | 3/1944 | Moeller | 83/303 |
| 3,411,390 | 11/1968 | Maynard et al. | 83/303 |
| 3,448,646 | 6/1969 | Bishop | 83/303 |
| 3,544,454 | 12/1970 | Muth et al. | 83/303 |
| 4,275,629 | 6/1981 | McDowell | 83/303 |

FOREIGN PATENT DOCUMENTS

| | | | |
|---|---|---|---|
| 136706 | 3/1950 | Australia | 83/303 |

*Primary Examiner*—E. R. Kazenske
*Assistant Examiner*—Paul M. Heyrana
*Attorney, Agent, or Firm*—Perry E. Turner

[57] ABSTRACT

For inserts in boxes of bottled and canned goods, there is disclosed pad forming apparatus in which rotary dies are adapted to remove the edge portions of a roll or sheet of material, e.g., chipboard, as the roll is fed towards a rotary knife from feed rollers, the feeds being selected to determine the lengths of the pads for a given run, and the speeds of the rotary dies and knife being selected to effect material removal and cutting to insure that the pads of the selected length have rounded corners. The die parts are on rollers between which the material moves from the feed rollers, and are positioned so the edges of the material pass between them. Each die set has a punch on one roller and a slug shedder or ejector on an opposing roller, the shedder being spring biased and radially movable. The dies punch out cusp cutouts, and the knife cuts the material along lines through the midportions of the die cuts. As the dies separate, the shedders are released to eject the slugs of removed material. The rollers have longitudinal channels in which the die parts are located, and along which they can be selectively positioned for cutting cusps from the edges of sheets of different widths.

3 Claims, 4 Drawing Figures

ROTARY APPARATUS FOR FORMING SHEETS WITH ROUNDED CORNERS

BACKGROUND OF THE INVENTION

1. Field of the Invention

This invention relates to high speed rotary sheet forming apparatus for making pads for the interiors of box containers and the like.

2. Description of the Prior Art

As heretofore known, pads are used in boxes to separate layers of bottled or canned goods. For example, a multi-cell partition in some packaging operations is opened and placed on the bottom of a box, and the cells are filled with bottles of a product being shipped. A pad is then placed over the partition to cover the contents in the cells. The packing is then completed by placing another partition on the pad, filling its cells with the bottled product, and sealing the box for shipment. In other packing operations, where such a box is filled with jars of fruits or the like, further protection is provided by the use of additional pads placed on the bottome of the box initially, and on the top of the upper tier of partitions.

It is desirable that the length and width of such pads shall be close enough to the interior dimensions of the box so the pad edges slidably glide into place when they are inserted. Sharp corners for such pads are a hindrance to desired high volume packing of goods, and also to quick unpacking. At a grocery, for example, an employee is often frustrated at attempts to remove a pad so as to get access to filled partitions covered by the pad. Accordingly, it is common practice to form pads with rounded corners. Finger space is thus available at the corners to facilitate proper placement in packing, and removal of pads when unpacking.

Heretofore, the best known method of forming pads with rounded corners involves the use of reciprocally operated punch apparatus. Typically, a punch is vertically movable periodically to punch cusp-shaped slugs out of the edge of a roll of chipboard. The slug passes with the punch into a mating die part, the slug falling through such mating part. The male punch is lifted to clear the material, which passes to a cutter which cuts it along a line that bisects cusps at the opposite edges.

This type of machinery suffers a number of drawbacks. Reciprocal action inherently subjects parts to undesired stresses, with consequent undesired down time for replacement and repair of worn items. Also, production is inherently limited. For example, it is known that for cutting only, a rotary cutting setup is significantly faster than a reciprocal cutting approach. However, while rotary apparatus is known for cutting pads, there is no known satisfactory rotary apparatus for both cutting such sheets and providing rounded corners for them.

Summary of the Invention

This invention embraces high speed rotary apparatus for cutting sheets of chipboard and the like of desired lengths, and with the corners thereof rounded. A roll of material is fed through feed rollers to pass between edge located male and female dies carried on respective shafts. This invention embraces rigid cusp shaped punches on one shaft, and spring-biased shedders on the other shaft, the shedders being cusp-shaped parts which are depressed when slugs are punched from the edges of the material by male punches, the spring biasing of the shedders being active when the dies rotate apart to return the shedders to pre-punch positions and cause them to eject the slugs. Also embraced by this invention is cooperable rotary cutter means carried on separate shafts, the punch and cutter shafts being of like pitch and timed so that the cutter cuts the material to bisect the cusp cutouts at the opposite edges. Further, this invention embraces provisions for the shafts which permit the male and female dies to be positioned at a variety of positions for punching edge portions of strips of a variety of widths. Also, this invention embraces rotary edge punching apparatus for cutting edge portions of any desired shape from strips or rolls of material fed between them.

DESCRIPTION OF PREFERRED EMBODIMENT

Figure 1:
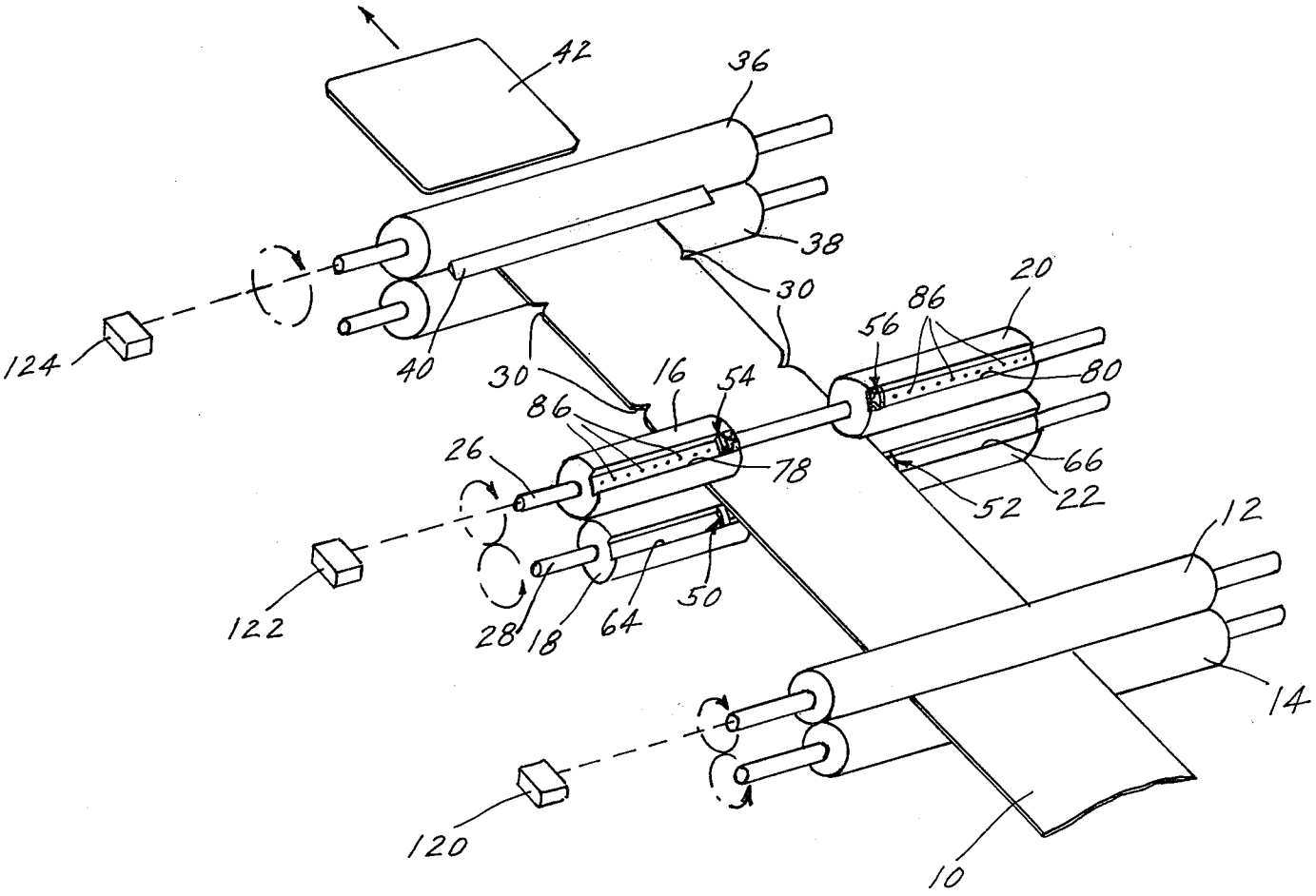
FIG. 1 is a perspective view of rotary apparatus of this invention, showing a roll or strip of chipboard or the like fed by feed rollers to pass between shafts which carry cooperative die sets for punching cusp segments from the edges, and rotary cutter means for cutting the board at the cusp centers.

Referring to FIG. 1, a strip 10 of chipboard or the like is fed from a roll (not shown) between feed rollers 12, 14. The strip passes between rollers 16, 18 and 20, 22, wherein the rollers 16, 20 are mounted on a shaft 26, and the rollers 18, 22 are mounted on a shaft 28. By die set means to be described more fully hereafter, the edges of the strip 10 are punched to provide cusp cutouts 30 spaced along its edges. The notched strip moves between cutter rollers 36, 38, wherein one roller carries a knife 40 which cuts the strip so as to bisect the cusps, so that each cut results in a pad 42 leaving the cutter with rounded corners.

Figure 3:
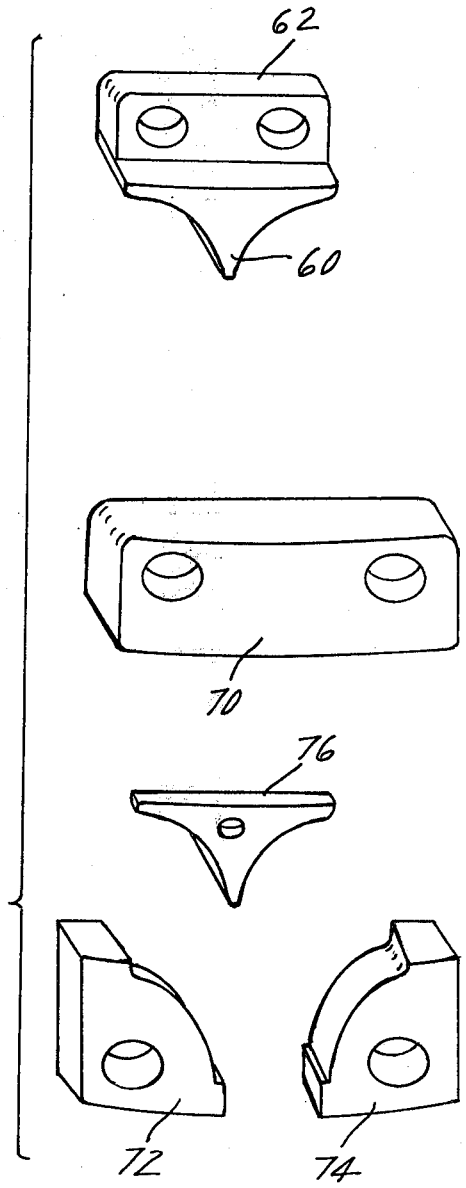
FIG. 3 is an exploded view of the parts of one of the die sets.
Figure 4:
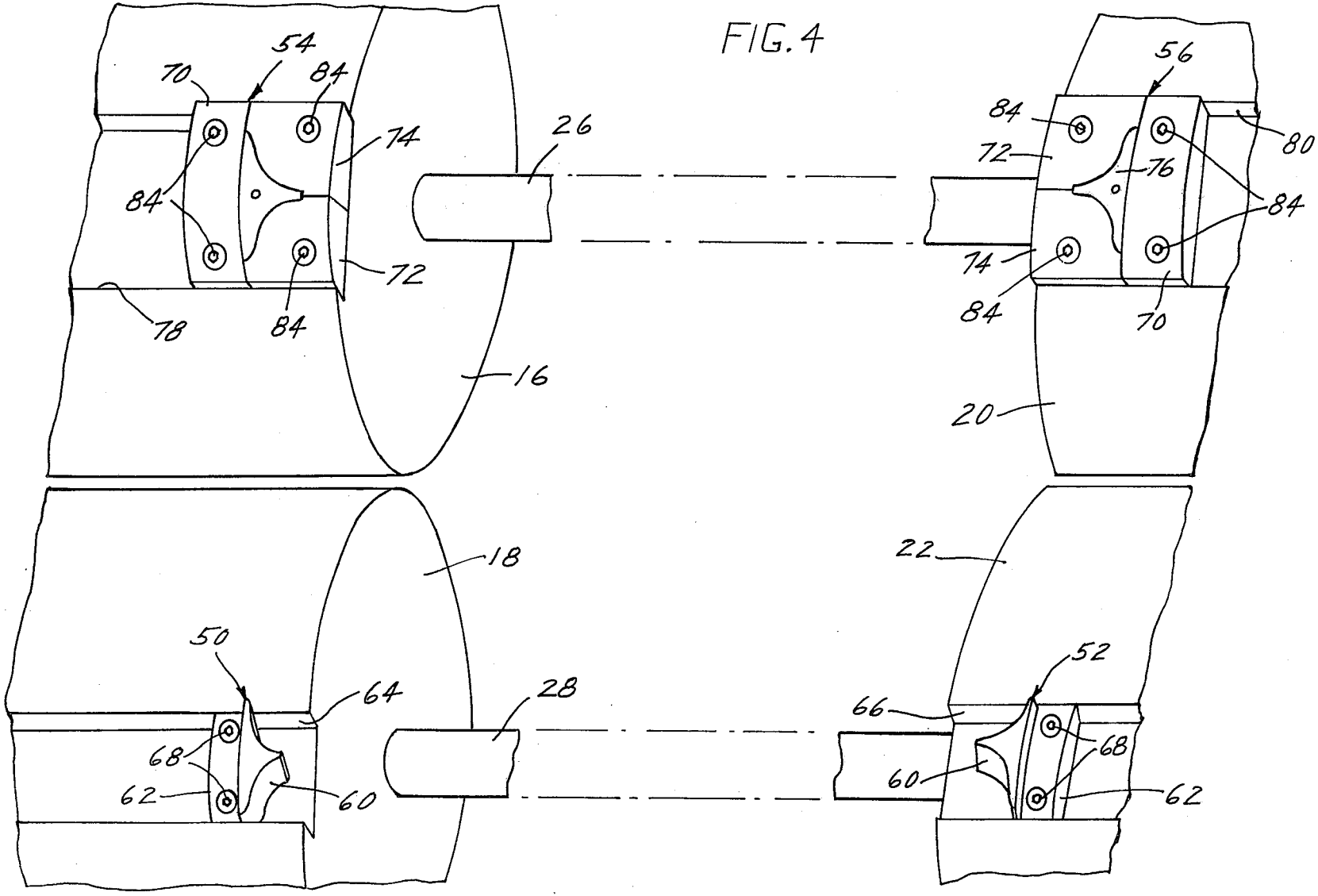
FIG. 4 is an enlarged, fragmentary perspective view of the confronting ends of the shafts, showing the arrangements of the parts of the die sets in greater detail.

In FIG. 1, the die sets are comprised of punches 50, 52 on the lower rollers 18, 22, and female dies 54, 56 carried on the upper rollers 16, 20. Referring to FIGS. 3 and 4 along with FIG. 1, each punch has a cusp-shaped portion 60 machined from suitable material, e.g., hardened tool steel, extending a predetermined height above a base block 62. As shown in FIG. 4, the rollers 18, 22 are formed with grooves 64, 66, and the punches are positioned in the grooves with the blocks 62 secured in place as with fasteners 68. As shown, the upper ends of the cusp portions 60 extend above the lateral surfaces of the rollers 18, 22.

Each female die is comprised of die parts or blocks 70, 72, 74, which together define a cusp shaped opening in which a cusp-shaped shedder or ejector member 76 is positioned for radial movement. As shown in FIG. 4, the rollers 16, 20 have grooves 78, 80 formed therein. The blocks 70, 72, 74 are positioned in the grooves and secured in place as with fasteners 84.

Figure 2:
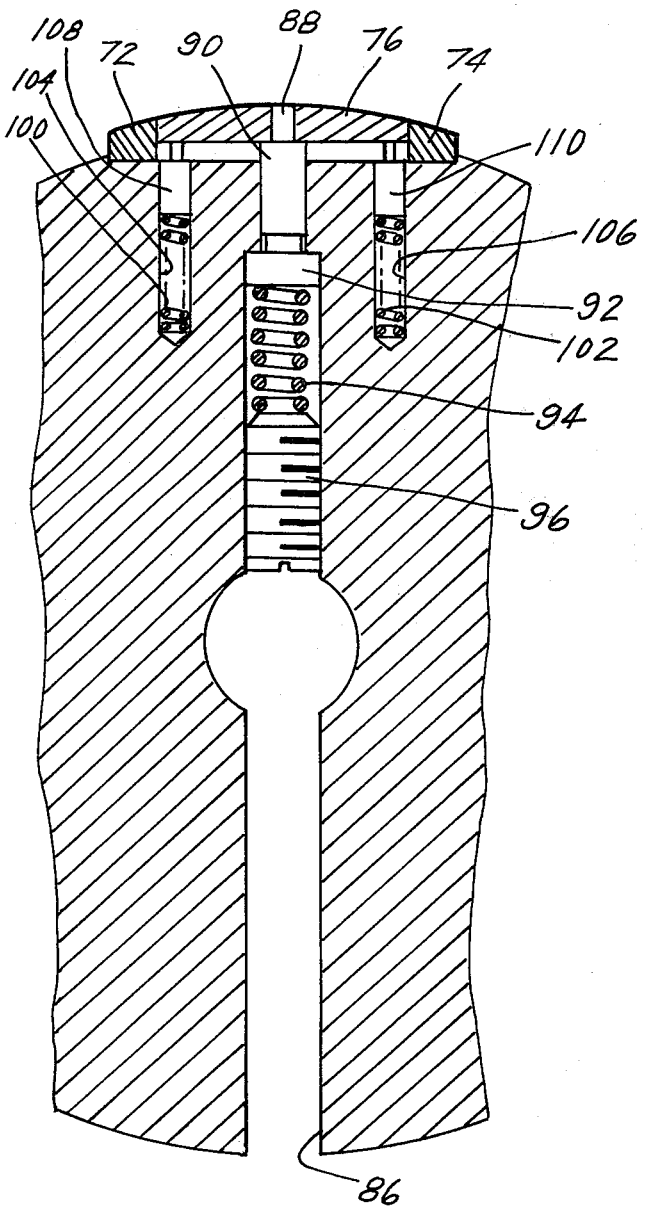
FIG. 2 is an enlarged, fragmentary sectional view of the portion of a shaft at which is mounted the female die portion of a die set in accordance with this invention.

Referring to FIG. 2 along with FIGS. 1 and 4, the member 76 is supported as a plunger that is normally spring biased to an outermost position. In this regard, the roller 16 is shown with a transverse or diametral bore 86 which at one end, shown as the upper end in FIG. 2, is of reduced diameter. The member 76 has an opening to receive the small end 88 of a pin 90 which is slidable in the reduced diameter portion of the bore 86. The pin 90 has an enlarged head 92 so that in assembling the parts, the pin is inserted through the large diameter portion of the bore 86 until the head 92 abuts the shoulder transition to the reduced diameter portion of the bore. The member 76 is then suitably secured to the end 88 of the pin, e.g., by a press fit.

A spring 94 is provided for biasing the pin 90 so that the head 92 is normally held against the aforementioned shoulder, at which position the outer surface of the member 76 is aligned with the outer surfaces of the blocks 72, 74. The spring 94 is preloaded for this purpose, as by a set screw 96. The bore 86 is appropriately tapped to permit the set screw 96 to be threaded into place to engage and compress the spring 94 to achieve the desired preloading.

With the above described arrangement, the shafts 26, 28 are suitably geared so that during each revolution, each punch portion 60 engages the associated member 76 and presses it inwardly against the bias of the apring 94. It is depressed a distance slightly greater than the thickness of the material of the strip 10 that is to be punched out. In this regard, it will be understood that the width of the material is the distance between the back edges of the punch portions 60. Accordingly, as engagement of each member 76 by the associated punch progresses from end to end, cusp-shaped slugs are sheared out of the material and pressed inwardly with the members 76. Immediately upon the punches disengaging the members 76, such members function as shedders to shed or eject the slugs. The slugs are easily and quickly removed, as by the use of conventional air blower means (not shown).

FIG. 2 also illustrates a further refinement which may be employed to advantagewhere parts as machined are reflected as loose tolerances which may permit a plunger member 76 to be subjected to lateral play and thus caused to be cocked. To overcome such a possibility, compression springs 100, 102 are shown inserted into the bottoms of openings 104, 106 bored into the roller body adjacent the ends of the member 76. Pins 108, 110 are inserted in the openings to rest on the springs 100, 102. The outer ends of the pins are reduced diameter portions which abut the bottom of the member 76. This arrangement serves to inhibit cocking of the member, which would resist proper plunger action. In this regard, when the associated punch engages one end of the member 76 to initiate its inward movement, the associated end spring resists movement of that end. The reaction force, or moment, is reflected in the entire body of the member 76 being restricted solely to radial movement, i.e., movement along the axis of the pin 90. During movement of the punch past the center of the member and over the other end thereof, the other end spring functions in the same manner. Accordingly, when the punch leaves contact with the member 76, it is reliably operable to eject the slug which was carried with it into the opening defined by the blocks 70, 72, 74.

As indicated, the rotary cutter means is time so the knife 40 cuts the strip along a line that bisects the cusps 30 in its opposite edges. To this end, where separate drives are employed for the cutter rollers and die set rollers, they are appropriately adjusted for each production run to insure that the knife 40 always cuts the strip correctly. In this regard, the drive for the feed rollers is a variable drive 120 which can be set at whatever speed is required for any desired lengths for the pads to be formed as described.

Thus, if there is to be a run of pads twice the length of that in a current production run, the drive for the feed rollers to adjusted accordingly to feed the strip through the die set and cutter rollers at twice the rate. This, of course, necessitates adjustment in the speeds of rotation of die set rollers and cutter rollers. The drives 122, 124 for the shafts of these rollers are also variable drives, so as to permit their speeds to be appropriately adjusted to achieve the required synchoronous operations. If desired, the die set rollers and cutter rollers may have their shafts operated from the same drive, with the same pitch and diameter for their drive gears. Also, this invention embraces any suitable controls for synchronizing these operations, e.g., pulse motors with so-called microdot controls.

Another feature of the invention is the ability to accommodate strips 10 of different widths. To this end, the rollers of the die sets shown in FIG. 1 are provided with the grooves which extend the lengths of the rollers. Thus, the die parts can be positioned and secured in the grooves at any desired locations. For example, if it is desired to notch the edges of strips of widely differing widths in different production runs, the grooves facilitate the placement of the die sets in any desired positions along the rollers. Typically, pad sizes are sufficiently standardized that incremental adjustments can be made in the spacings between the die sets. Thus, for one-inch incremental changes in pad widths, the die sets can be arranged for individual step movements of a half inch. For this purpose, rollers 16, 20 may be provided with transverse bores 86 at half inch intervals for the purpose of positioning the members 76 for plunger and shedding actions as previously described for FIG. 2. It will be understood that there are appropriate provisions for fastening the blocks 62, 70, 72, 74 to the roller bodies. Also, it suffices that the rotary cutter has a knife sufficiently long to cut strips of the maximum widths for which pads with rounded corners are to be formed.

This invention, of course, embraces the use of apparatus as above described, wherein the die sets are not capable of being moved to a variety of positions. That is, for different widths of pads, there may be pairs of shafts for the various widths, with each pair having rollers with die sets spaced apart the distance for one pad width.

While the main object of this invention is apparatus to produce pads with rounded corners, it will be understood that this invention is not so limited. For example, without departing from the spirit and scope of the invention, one can utilize a plunger member and associated punch and mold blocks of any desired configuration to remove material of that particular pattern. The apparatus can be used for edge treatment, such as forming scallops in an edge of material; the scallops may be angles or curves. For corner treatment of pads, the invention embraces cooperative die sets for other than cusps, e.g., angle cutouts formed with square or rectangular punch and shedder members.

I claim:

1. In pad forming apparatus, rotary edge notching apparatus comprising, in combination:

two pairs of parallel rollers on respective shafts adapted for rotation in opposite directions;

a respective punch member secured to one roller of each pair, each punch member having a portion of a configuration to be removed from the edges of material to be passed between the rollers, each of such portions projecting from the lateral surface of a respective one roller of each pair; and respective female die means carried by the other roller of each pair, each female die means including a radially movable element of said configuration; guide means surrounding each said element and defining an opening of said configuration; and means carried by said other roller of each pair to resiliently bias its said element to a position wherein it projects from the lateral surface of said other roller, said punch members and female die means being operable upon sheet material being passed between said pairs of rollers so that said punch members depress said elements into said openings along with a portion of the material of said configuration, said resilient biasing means and said elements being operable upon separation of said punch members and said elements to eject said portions of the material.

2. The combination of claim 1, further including longitudinal channels in said rollers, said punch members being located in the channels of the rollers of said one pair, said female die means being located in the channels of the rollers of said other pair;

and means for removably securing said punch members and female die means to selected positions in their channels, thereby to permit cusps to be formed in the edges of strips of of material of different widths, wherein said configurations of said punch members and said elements are cusps.

3. The combination of claim 1, further including radial bores in the rollers of said other pair, wherein the resilient biasing means for each said element includes a respective preloaded spring in each said radial bore;

and a pin secured to each said element and engaged by one of said springs.

* * * * *